US011473455B2

(12) United States Patent
Koehler et al.

(10) Patent No.: US 11,473,455 B2
(45) Date of Patent: Oct. 18, 2022

(54) CONTROL VALVE WITH A SEALING CONTOUR ON A SLEEVE-SHAPED HYDRAULIC GUIDE ELEMENT; AND COMPONENT HAVING A CONTROL VALVE AND CAMSHAFT PHASER

(71) Applicant: Schaeffler Technologies AG & Co. KG, Herzogenaurach (DE)

(72) Inventors: David Koehler, Egloffstein (DE); Christian Berft, Cadolzburg (DE); Jens Hoppe, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 17/251,845

(22) PCT Filed: Apr. 24, 2019

(86) PCT No.: PCT/DE2019/100378
§ 371 (c)(1),
(2) Date: Dec. 14, 2020

(87) PCT Pub. No.: WO2020/001675
PCT Pub. Date: Jan. 2, 2020

(65) Prior Publication Data

US 2021/0254513 A1 Aug. 19, 2021

(30) Foreign Application Priority Data

Jun. 26, 2018 (DE) ..... 10 2018 115 343.0

(51) Int. Cl.
*F01L 1/344* (2006.01)

(52) U.S. Cl.
CPC ... *F01L 1/3442* (2013.01); *F01L 2001/34426* (2013.01); *F01L 2001/34479* (2013.01)

(58) Field of Classification Search
CPC ..... F01L 1/3442; F01L 2001/34433; F01L 2001/34426; F01L 2001/3443;
(Continued)

(56) References Cited

U.S. PATENT DOCUMENTS 5,263,443 A 11/1993 Schechter et al.
7,389,756 B2 * 6/2008 Hoppe ..... F15B 21/041 123/90.31
(Continued)

FOREIGN PATENT DOCUMENTS

CN 1724852 A 1/2006
CN 101273187 A 9/2008
(Continued)

OTHER PUBLICATIONS

DE-102014220727, English Language Machine Translation (Year: 2016).*

*Primary Examiner* — Devon C Kramer
*Assistant Examiner* — Wesley G Harris

(57) ABSTRACT

This disclosure relates to a control valve for a hydraulic camshaft phaser. The control valve includes a screw body having a cavity, a plurality of connections opening into the cavity, and a sleeve-shaped hydraulic guide element firmly inserted radially inside the cavity. At least part of the hydraulic guide element consists of plastic. The hydraulic guide element includes a plurality of pressure medium channels which open into its radial interior, each of which is connected to at least one of the connections. A control piston is displaceably accommodated in the hydraulic guide element, and, depending on the position of the control piston, connects the connections to each other. A sealing contour provided on a radial outer side of the hydraulic guide element contacts the screw body, sealing the pressure
(Continued)

medium channels with respect to each other and/or with respect to axial ends of the hydraulic guide element.

20 Claims, 3 Drawing Sheets

(58) Field of Classification Search
CPC .. F01L 2001/34423; F01L 2001/34479; F15B 13/0402; F16K 11/0704–0716
USPC ..... 123/90.17, 90.15; 137/625.34
See application file for complete search history.

(56) References Cited

U.S. PATENT DOCUMENTS

| | | | | |
|---|---|---|---|---|
| 9,206,714 | B2 * | 12/2015 | Koehler | F01L 1/3442 |
| 2006/0027199 | A1 * | 2/2006 | Yoshijima | F02F 7/006 123/90.34 |
| 2007/0095315 | A1 * | 5/2007 | Hoppe | F01L 1/34 123/90.17 |
| 2014/0116365 | A1 | 5/2014 | Scheidig | |
| 2017/0022854 | A1 * | 1/2017 | Takada | F01L 1/047 |
| 2019/0368387 | A1 * | 12/2019 | Mitsutani | F16K 11/0712 |

FOREIGN PATENT DOCUMENTS

| | | | | |
|---|---|---|---|---|
| CN | 103314190 | A | 9/2013 | |
| CN | 103573319 | A | 2/2014 | |
| CN | 103909333 | A | 7/2014 | |
| CN | 105909333 | A | 8/2016 | |
| CN | 106715843 | A | 5/2017 | |
| CN | 107208504 | A | 9/2017 | |
| DE | 102005052481 | A1 | 5/2007 | |
| DE | 102008006179 | A1 * | 7/2009 | F01L 1/3442 |
| DE | 102010018211 | A1 | 10/2011 | |
| DE | 102013209348 | A1 * | 11/2014 | F01L 1/344 |
| DE | 102014220278 | A1 | 4/2016 | |
| DE | 102014220727 | A1 * | 4/2016 | F01L 1/344 |
| DE | 102014222590 | A1 | 5/2016 | |
| DE | 102015219154 | A1 | 4/2017 | |
| DE | 102016200788 | A1 | 7/2017 | |

* cited by examiner

CONTROL VALVE WITH A SEALING CONTOUR ON A SLEEVE-SHAPED HYDRAULIC GUIDE ELEMENT; AND COMPONENT HAVING A CONTROL VALVE AND CAMSHAFT PHASER

CROSS-REFERENCE TO RELATED APPLICATIONS

This application is the U.S. National Phase of PCT Application NO. PCT/DE2019/100378 filed on Apr. 24, 2019 which claims priority to DE 10 2018 115 343.0 filed on Jun. 26, 2018, the entire disclosures of which are incorporated by reference herein.

TECHNICAL FIELD

This disclosure relates to a control valve for a hydraulic camshaft phaser of an internal combustion engine and also to a component consisting of this control valve with a hydraulic camshaft phaser.

BACKGROUND

Generic control valves are already sufficiently known from the prior art. For example, DE 10 2005 052 481 A1 and U.S. Pat. No. 7,389,756 B2 disclose a control valve for a device for the variable setting of the control times of gas exchange valves of an internal combustion engine. A hollow formed valve housing of the control valve has at least one inlet connection, at least one outlet connection, and at least two working connections. A hollow pressure medium guide insert is arranged inside the valve housing, in order to thus form at least one pressure medium channel extending essentially in the axial direction. The pressure medium guide insert consists of a plastic.

A disadvantage of the generic embodiments with a hydraulic guide element made of plastic has been found to be disadvantageous in that in certain cases, depending on the production-related tolerances within the tolerance limits, either a leak, and thus a relatively high leakage of the control valve, occurs during operation, or relatively difficult adjustment, including jamming of the control piston, occurs.

SUMMARY

It is therefore the object of the present disclosure to eliminate the disadvantages known from the prior art and, in particular, to provide a control valve which has both the lowest possible leakage and effortless adjustability.

This is achieved according to the disclosure in that, on a radial outside of the hydraulic guide element, there is provided a sealing contour, resting against the screw body and sealing the pressure medium channels from one another and/or to the axial ends of the hydraulic guide element.

This sealing contour provides a sealing geometry that protrudes radially outward and that significantly reduces the total surface area of the hydraulic guide element contacting the screw body. As a result, a pressure force acting radially inward from the screw body on the hydraulic guide element is reduced and the risk of the control piston jamming during operation is reduced. At the same time, due to the nature of the sealing contour, the respective connection remains reliably sealed off from the other connections. This also ensures that operation is largely leak-free.

Further advantageous embodiments are explained in more detail below.

Accordingly, it is also expedient if the sealing contour is dimensioned and designed such that it is compressible/elastically deformable in a radial direction. In this way, the manufacturing tolerances that occur are compensated for in a simple manner by pressing the hydraulic guide element into the screw body.

With regard to the formation of the sealing contour, it is also expedient if a first sealing portion of the sealing contour is arranged to act in a circumferential direction between a first pressure medium channel, optionally connected to an inlet connection, and a second pressure medium channel, optionally connected to a first working connection.

If the first sealing portion is formed by an elevation extending along the longitudinal axis (optionally extending in a straight line), the first sealing portion is implemented in a particularly compact manner.

In this context, it should also be pointed out that it is expedient if a plurality of the first pressure medium channels and/or the second pressure medium channels are arranged distributed along the circumference of the hydraulic guide element and a first sealing portion is provided on each of two opposite circumferential sides of the first pressure medium channel and/or the second pressure medium channel.

A second sealing portion of the sealing contour can be arranged to act in an axial direction of the longitudinal axis and/or in the circumferential direction between the first pressure medium channel and a third pressure medium channel, and optionally connected to a second working connection.

If the second sealing portion is embodied as an elevation that extends in a curved manner in the circumferential direction, the compressive force acting on the hydraulic guide element by the screw body is distributed as evenly as possible in the axial direction.

Furthermore, it is expedient if a third sealing portion of the sealing contour is attached so as to act in the axial direction between the second pressure medium channel and the third pressure medium channel.

The third sealing portion can be a sealing portion extending in a curved manner in the circumferential direction and which in turn is embodied as an elevation. Together with the second sealing portion, the third sealing portion can further form an undulating course of part of the sealing contour in the circumferential direction. This results in an even distribution of the pressure force between the screw body and the hydraulic guide element.

If a fourth sealing portion of the sealing contour, which seals at least one pressure medium channel from an outlet, is attached towards a first end of the hydraulic guide element in the axial direction, the sealing contour assumes further sealing functions. In this context, it is advantageous if the fourth sealing portion extends essentially along an imaginary annular circular line.

Furthermore, it is advantageous if a fifth sealing portion of the sealing contour, sealing at least one pressure medium channel from an inlet, is attached towards a second end of the hydraulic guide element in the axial direction. This fifth sealing portion is, in turn, embodied as an elevation extending arcuately in the circumferential direction.

If the sealing contour is embodied as an integral component of an outer part of the hydraulic guide element made of plastic, the sealing contour is implemented particularly robustly with the outer part as a whole.

The outer part can be firmly connected to an inner part of the hydraulic guide element made of a metal. In one embodiment the outer part is formed as an overmold around the inner part.

For the lowest possible strain on the hydraulic element inwards in the radial direction, the outside of the hydraulic guide element can be arranged axially and/or in the circumferential direction between the sealing portions of the sealing contour with a gap/play in the radial direction towards the screw body.

Furthermore, the different sealing portions of the sealing contour can have a ramp extending in the axial direction/a ramp-shaped transition so that they can be installed as easily as possible when the hydraulic guide element is inserted into the screw body during installation.

The disclosure also relates to a component consisting of a hydraulic camshaft phaser and a control valve according to the disclosure according to at least one of the embodiments described above.

In other words, according to the disclosure, a sealing contour is thus implemented on an oil guide sleeve (hydraulic guide element) of a central valve (control valve). The individual sealing contour is positioned on the outside of the plastic oil guide sleeve.

BRIEF DESCRIPTION OF THE DRAWINGS

In the following, the invention is now explained in more detail with reference to figures.

In the figures.

DETAILED DESCRIPTION OF THE EMBODIMENTS

The figures are only schematic in nature and serve only for understanding the disclosure. The same elements are provided with the same reference symbols.

Figure 1:
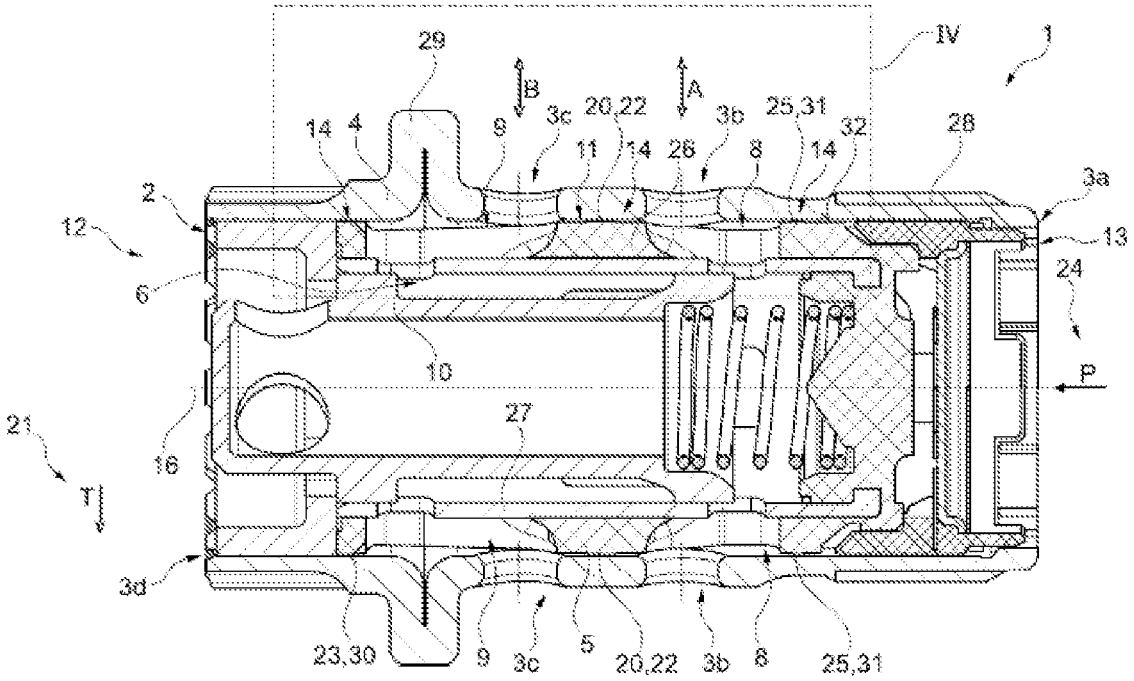
FIG. 1 shows a longitudinal sectional view of a control valve according to the invention according to an example embodiment.

FIG. 1 shows a control valve 1 according to the disclosure in terms of its basic structure. The control valve 1 is typically designed as a central valve and, when used for controlling a hydraulic camshaft phaser, is correspondingly inserted radially within a rotor of the camshaft phaser. The control valve 1 consequently forms a plurality of connections 3*a*, 3*b*, 3*c*, 3*d* which, during operation, are hydraulically connected to an inlet 24 (P for pump side), an outlet 21 (T for tank side) and working chambers A, B of the hydraulic camshaft phaser. The different states of the camshaft phaser are typically implemented during operation depending on the position of a control piston 10 of the control valve 1.

The control valve 1 has a hollow formed screw body 4, having connections 3*a* to 3*d*, which body, during operation, is screwed onto a corresponding receptacle on a camshaft, affixing a rotor of the camshaft phaser to the camshaft. Therefore, on a radial outer side of the screw body 4, there is provided, among other things, a threaded area 28 and a support area 29, formed offset from the threaded area 28 in an axial direction (i. e., along a longitudinal axis 16). In this context, for the sake of completeness, it should be noted that the directional information used, axially, radially and in the circumferential direction, is used in relation to the central longitudinal axis 16. The screw body 4 in this embodiment is open towards its two opposite axial ends. A first axial end of the screw body 4 forms a first connection 3*a* in the form of an inlet connection; a second end of the screw body 4, opposite the first end, forms a further connection 3*d* (hereinafter referred to as the fourth connection 3*d*) in the form of an outlet connection. The first connection 3*a* is consequently hydraulically connected to the inlet 24 during operation; the fourth connection 3*d* is hydraulically connected to the outlet 21.

The screw body 4, which is formed to be hollow over its entire length, thus forms a cavity 2 on its radial inside. Within this cavity 2, a hydraulic medium guide element 5 is firmly inserted into the screw body 4. The hydraulic medium guide element 5 is fixed on the screw body 4 radially by means of a form fit and axially by means of a locking ring and an axial surface of the screw body 4, alternatively a pressed-in ring. The screw body 4 itself is formed from a metal, whereas the hydraulic medium guide element 5 can consist at least partially of a plastic. The hydraulic medium guide element 5, together with the control piston 10 serves to guide hydraulic medium, depending on the displacement position of the control piston 10, from the inlet 24 to a second connection 3*b* or a third connection 3*c* on the side of the working chambers, or from the respective second or third connection 3*b*, 3*c* to the connection 3*d*. For this purpose, the hydraulic medium guide element 5, as can also be seen in connection with FIGS. 2 and 3, has a plurality of pressure medium channels 7, 8, 9.

A first pressure medium channel 7 of the hydraulic medium guide element 5 extends in the axial direction and penetrates the hydraulic medium guide element 5 towards one axial end in the radial direction. The first pressure medium channel 7 hydraulically connects the first connection 3*a* to the radial interior 6 of the hydraulic medium guide element 5. A second pressure medium channel 8, which is also embodied as a radial passage, is arranged offset in the circumferential direction with respect to the first pressure medium channel 7. The second pressure medium channel 8 is hydraulically connected to the second connection 3*b*, and consequently to a first working chamber A of the camshaft phaser. A third pressure medium channel 9, which also penetrates the hydraulic medium guide element 5 in the radial direction to form a bottom surface 34 arranged radially inwardly of the radially outer side 11, is offset in the axial direction from the second pressure medium channel 8 or offset in the circumferential direction, and offset in the axial direction from the first pressure medium channel 7. The third pressure medium channel 9 is hydraulically connected to the third connection 3*c*, and consequently to a second working chamber B of the camshaft phaser.

In the interior 6 of the hydraulic medium guide element 5, the control piston 10 is arranged, in a typical manner, displaceably in the axial direction in order to implement the various positions of the control valve 1 and thus to connect the second and third connections 3*b* and 3*c* to the first connection 3*a* or to the fourth connection 3*d* or to each other.

Figure 2:
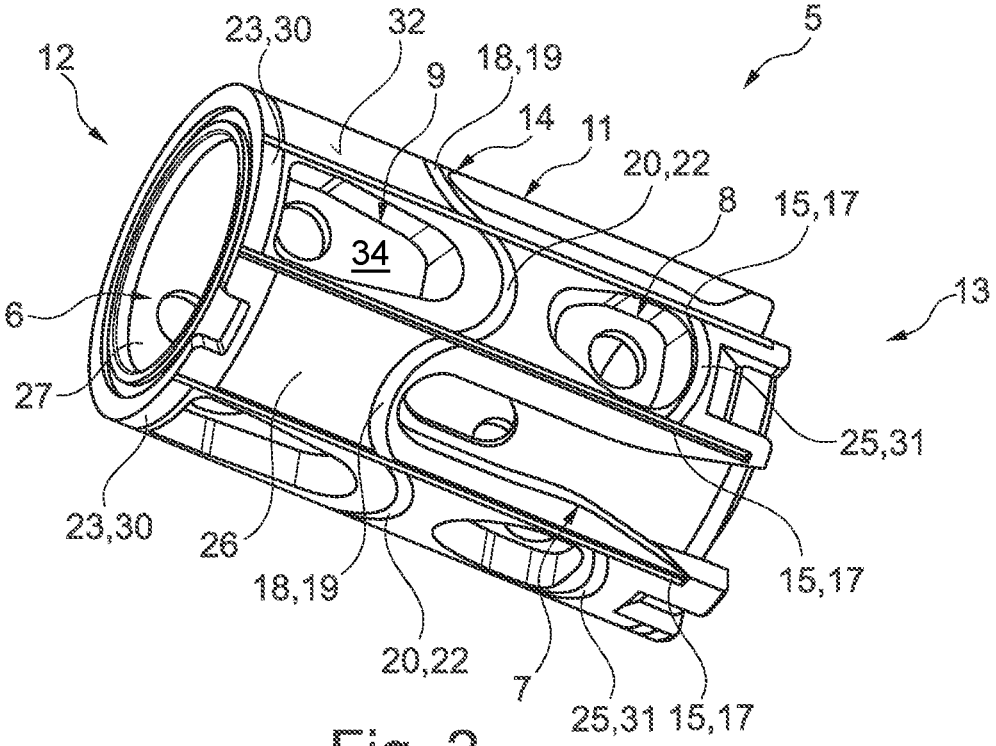
FIG. 2 shows a perspective view of a hydraulic guide element inserted in the control valve according to FIG. 1 towards its radial outside, on which a sealing contour according to the invention is implemented.
Figure 3:
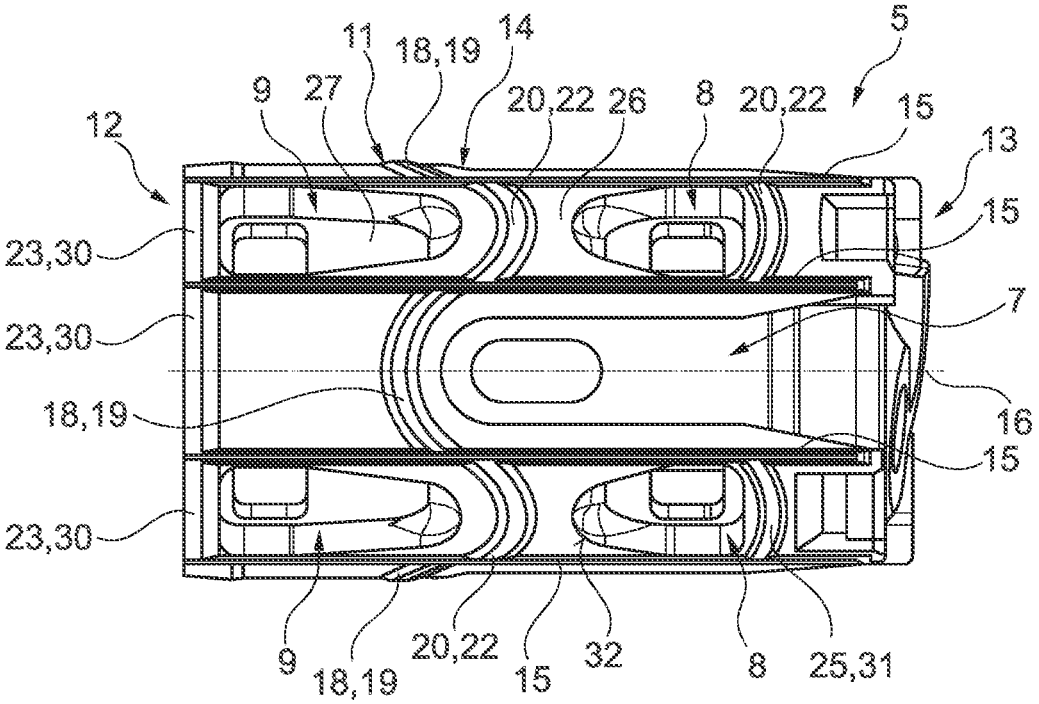
FIG. 3 shows a side view of the hydraulic guide element according to FIG. 2.
Figure 4:
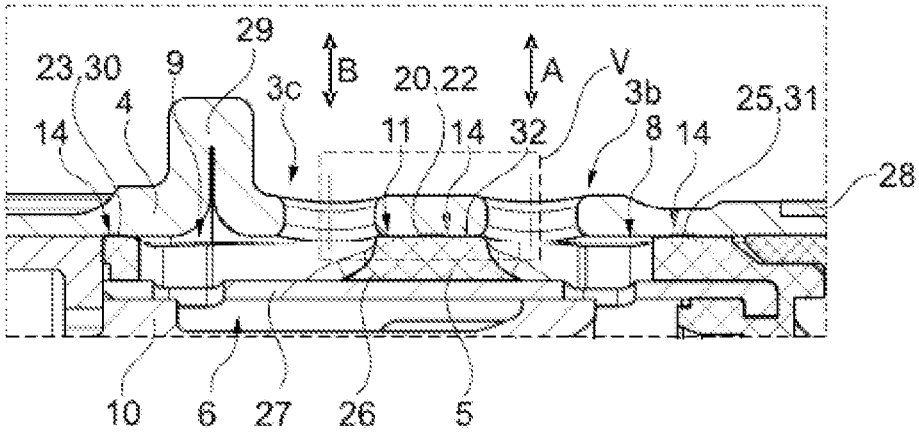
FIG. 4 shows a detailed view of the control valve in the area marked with "IV" in FIG. 1.
Figure 5:
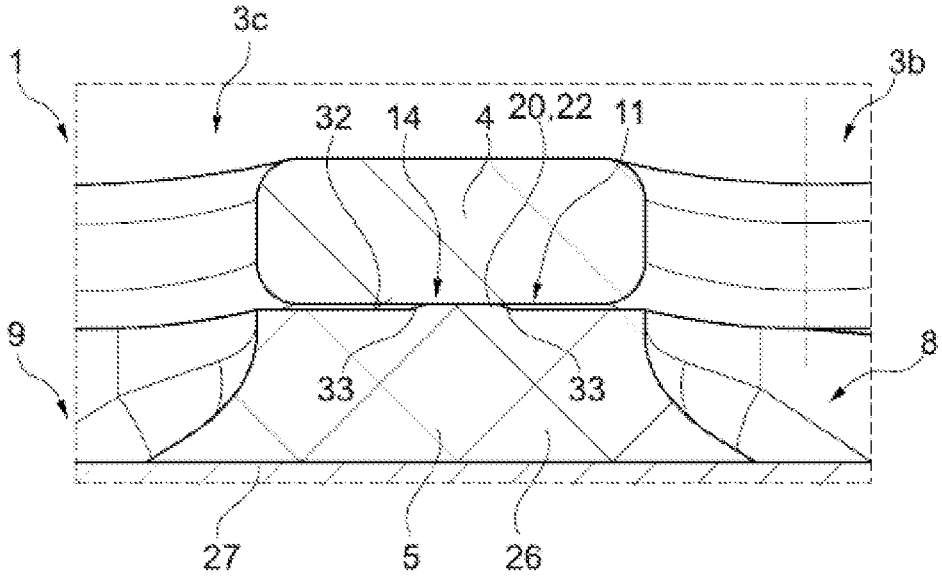
FIG. 5 shows a detailed view of the control valve in the area marked with "V" in FIG. 4.

According to the disclosure, as illustrated in FIGS. 2, 4 and 5, a sealing contour 14 is applied to a radial outer side 11 of the hydraulic medium guide element 5, namely to an outer side 11 of an outer part 26 of the hydraulic medium guide element 5 made of plastic, through which sealing contour 14 the pressure medium channels 7, 8, 9 are separated/sealed from one another in the axial direction and in the circumferential direction (in the radial gap between the screw body 4 and the hydraulic medium guide element 5). The pressure medium channels 7, 8, 9 are also sealed by this sealing contour 14 with respect to the axial ends 12, 13 of the hydraulic medium guide element 5 and thus to the outlet 21 and the inlet 24.

The sealing contour 14 is formed by a plurality of sealing portions 15, 18, 20, 23, 25 in the form of elevations 17, 19, 22, 30, 31 on the outer side 11. The elongated sealing portions 15, 18, 20, 23, 25 each protrude in the radial direction from an outer jacket side 32 of the hydraulic medium guide element 5 and are in tight contact with an inner side of the screw body 4.

A first sealing portion 15 of the sealing contour 14 is formed as a first elevation 17 extending straight in the axial direction. This first sealing portion 15 serves to seal the first pressure medium channel 7 from the second pressure medium channel 8 in the circumferential direction. In this context, it can also be seen that a plurality of first pressure medium channels 7, second pressure medium channels 8, and third pressure medium channels 9 are arranged distributed in the circumferential direction. Viewed in the circumferential direction, one of the first pressure medium channels 7 is arranged between two second pressure medium channels 8 or between two third pressure medium channels 9. With respect to its first circumferential side and with respect to its second circumferential side, which is opposite the first circumferential side in the circumferential direction, the first pressure medium channel 7 is separated by a first sealing portion 15 each.

A second sealing portion 18 of the sealing contour 14 is inserted between the first pressure medium channel 7 and the third pressure medium channel 9. The second sealing portion 18 is implemented by a second elevation 19 that extends arcuately in the circumferential direction. The second sealing portion 18, together with the first sealing portion 15, thus forms a seal for the first pressure medium channel 7 in the circumferential direction and with respect to a (first) end 12 of the hydraulic medium guide element 5.

In order to seal the second pressure medium channel 8 with respect to the (first) end 12, a further third sealing portion 20 of the sealing contour 14 is provided, likewise extending arcuately in the circumferential direction. With respect to a further (second) end 13 of the hydraulic medium guide element 5, the second pressure medium channel 8 is sealed by a further (fifth) sealing portion 25 in the form of a fifth elevation 31. This fifth sealing portion 25 also extends arcuately in the circumferential direction. As can be seen in FIG. 2, the second sealing portion 18 is matched to the third sealing portion 20 and arranged relative to it such that these two sealing portions 18, 20 extend one after the other along an undulating reference line in the circumferential direction.

A fourth sealing portion 23 seals the third pressure medium channel 9 with respect to the second end 13 in the axial direction. The fourth sealing portion 23 is implemented by a plurality of fourth elevations 30. Overall, a plurality of fourth elevations 30 are formed one after the other in the circumferential direction. The fourth sealing portion 23 extends essentially annularly.

Returning to FIG. 1, it can also be clearly seen that the hydraulic medium guide element 5, in a typical manner, in addition to the outer part 26, has an inner part 27 made of a metal, possibly a sheet metal. The inner part 27 forms a sliding surface for the control piston 10 towards the interior 6 of the hydraulic medium guide element 5. The outer part 26 is applied to the inner part 27 in the form of an overmold. Thus, in the fully cured state, the outer part 26 surrounds the inner part 27 in a form-fitting manner.

In FIG. 5 it can also be seen that the sealing portions 15, 18, 20, 23, 25, as shown here representatively for the third sealing portion 20, each have ramp-shaped transitions 33 in the axial direction towards the ends 12 and 13, by means of which they transition to the outer diameter of the outer jacket side 32.

In other words, according to the disclosure, a soft sealing contour 14 on the outer diameter of the overmold (outer part 26) represents a type of tolerance compensation. It could also be stated that a stiffness of the soft sealing contour 14 is lower than a stiffness of the outer part 26. The sealing contour 14 between the individual oil channels (pressure medium channels 7, 8, 9) is intended to significantly reduce the amount of material that overlaps for "minimum" parts and thus allow for greater overlap in these local areas, while still reducing the risk of jamming. For the same tolerances, the maximum gap is thus reduced by the sealing contour 14, reducing the risk of leakage. The tool for overmolding 26 the steel sleeve (inner part 27) consists of a plurality of sliders in order to be able to produce the oil channels 7, 8, 9 on the outer diameter. There are tool separation points between each of the sliders, creating a burr. Since these burrs can only be avoided or removed with relatively great effort, they are hidden in an axial groove. This groove creates a channel which increases the leakage; in order to avoid this leakage, the groove is laterally sealed by a bead (first elevation 17). This sealing bead 17 thus represents the axial sealing contour (first sealing portion 15) between the sliders, and thus between the P channels (first pressure medium channel 7) to the A and B channels (second pressure medium channel 8 and third pressure medium channel 9). In addition, there are sealing contours 18, 20, 23, 25 in the circumferential direction for sealing between the A channel 8 and the B channel 9 and with respect to the tank (outlet 21). The sealing contour 14 should not have any sharp edges in order to avoid damaging the contour 14 when it is joined into the housing (screw body 4). Soft transitions 33 in the axial direction ensure this. The sealing contour 14 represents a simplification for manufacturing, since a high-precision diameter tolerance and shape no longer need to be achieved on the entire cylinder, but primarily only in the area of the sealing contour 14. The plastic between the sealing areas 15, 18, 20, 23, 25 is deliberately designed with play in relation to the housing 4 so as not to generate any pressure on the steel sleeve 27 in these areas.

LIST OF REFERENCE SYMBOLS

1 control valve
2 cavity
3*a* first connection
3*b* second connection
3*c* third connection
3*d* fourth connection
4 screw body
5 hydraulic medium guide element
6 interior
7 first pressure medium channel
8 second pressure medium channel
9 third pressure medium channel
10 control piston
11 outer side
12 first end of the hydraulic medium guide element
13 second end of the hydraulic medium guide element
14 sealing contour
15 first sealing portion
16 longitudinal axis

17 first elevation
18 second sealing portion
19 second elevation
20 third sealing portion
21 outlet
22 third elevation
23 fourth sealing portion
24 inlet
25 fifth sealing portion
26 outer part
27 inner part
28 threaded area
29 support area
30 fourth elevation
31 fifth elevation
32 outer jacket side
33 transition
34 bottom surface of third pressure medium channel 9

The invention claimed is:

1. A control valve for a hydraulic camshaft phaser, the control valve comprising:
- a screw body having a cavity and a plurality of connections opening into the cavity,
- a sleeve-shaped hydraulic guide element disposed inside of the cavity, at least part of the hydraulic guide element constructed of plastic, the hydraulic guide element having:
  - a radial interior,
  - a radial outer side defining a plurality of pressure medium channels, each of the pressure medium channels:
    - arranged to open into the radial interior,
    - connected to at least one of the connections, and
    - recessed radially inwardly from the radial outer side, and
- a control piston configured to move axially within the hydraulic guide element, and
- a sealing contour extending radially outward from the radial outer side of the hydraulic guide element, the sealing contour configured to contact the screw body and seal each of the plurality of pressure medium channels from each other.

2. The control valve of claim 1, wherein a first sealing portion of the sealing contour is operatively arranged between a first pressure medium channel and a second pressure medium channel in a circumferential direction.

3. The control valve of claim 2, wherein at least one of the pressure medium channels forms a bottom surface, the bottom surface arranged radially inwardly of the radial outer side.

4. The control valve of claim 2, wherein a second sealing portion of the sealing contour is operatively arranged between the first pressure medium channel and a third pressure medium channel in at least one of an axial direction of a longitudinal axis or in the circumferential direction.

5. The control valve of claim 4, wherein the second sealing portion is configured as an elevation extending arcuately in the circumferential direction.

6. The control valve of claim 5, wherein a third sealing portion of the sealing contour is operatively arranged between the second pressure medium channel and the third pressure medium channel in the axial direction.

7. The control valve of claim 6, wherein a fourth sealing portion of the sealing contour is arranged towards a first end of the hydraulic guide element in the axial direction, sealing at least one of the plurality of pressure medium channels from an outlet.

8. The control valve of claim 7, wherein a fifth sealing portion of the sealing contour is arranged towards a second end of the hydraulic guide element in the axial direction, sealing at least one of the plurality of pressure medium channels from an inlet.

9. The control valve of claim 1, wherein the sealing contour is an integral part of the at least part of the hydraulic guide element constructed of plastic.

10. A component comprising a hydraulic camshaft phaser and the control valve of claim 1.

11. The control valve of claim 1, wherein the sealing contour is configured to seal each of the plurality of pressure medium channels from at least one of a fluid inlet to the control valve or a fluid outlet of the control valve.

12. A control valve for a hydraulic camshaft phaser, the control valve comprising:
- a body having a cavity and a plurality of connections opening into the cavity,
- a sleeve-shaped hydraulic guide element disposed inside of the cavity, the hydraulic guide element having:
  - an inner part having a radial interior,
  - a plurality of pressure medium channels arranged to open into the radial interior, each of the plurality of pressure medium channels connected to at least one of the plurality of connections, and
  - a control piston configured to move axially within the hydraulic guide element,
  - a plastic outer part formed around the inner part, and
  - a deformable sealing contour extending from a radial outer side of the plastic outer part, the deformable sealing contour configured to engage the cavity of the body and seal at least one of the plurality of pressure medium channels.

13. The control valve of claim 12, wherein a first sealing portion of the deformable sealing contour extends in an axial direction between a first one and a second one of the plurality of pressure medium channels.

14. The control valve of claim 13, wherein a width of the first sealing portion is less than a circumferential distance between the first one and the second one of the plurality of pressure medium channels.

15. The control valve of claim 13, wherein a second sealing portion of the deformable sealing contour extends in a circumferential direction between the second one and a third one of the plurality of pressure medium channels.

16. The control valve of claim 15, wherein the second sealing portion extends arcuately in the circumferential direction.

17. The control valve of claim 15, wherein a width of the second sealing portion is less than an axial distance between the second one and third one of the plurality of pressure medium channels.

18. The control valve of claim 12, wherein the hydraulic guide element is pressed into the cavity of the body so that the deformable sealing contour deforms to a size of the cavity.

19. The control valve of claim 12, wherein a stiffness of the deformable sealing contour is lower than a stiffness of the plastic outer part.

20. The control valve of claim 12, wherein the deformable sealing contour is configured with a ramp-shaped transition in an axial direction of the hydraulic guide element.

* * * * *